US005620155A

United States Patent [19]

Michalek

[11] Patent Number: 5,620,155

[45] Date of Patent: Apr. 15, 1997

[54] RAILWAY TRAIN SIGNALLING SYSTEM FOR REMOTELY OPERATING WARNING DEVICES AT CROSSINGS AND FOR RECEIVING WARNING DEVICE OPERATIONAL INFORMATION

[76] Inventor: Jan K. Michalek, 496 Willrich Dr., Newark, Ohio 43055

[21] Appl. No.: 409,142

[22] Filed: Mar. 23, 1995

[51] Int. Cl.[6] ..... B61L 23/00; B61L 25/00; B61L 7/06

[52] U.S. Cl. ..... 246/121; 246/122 R; 246/125; 246/473.1; 340/902

[58] Field of Search ..... 246/120, 121, 246/122 R, 125, 167 R, 174, 473.1; 340/901, 902, 904

[56] References Cited

U.S. PATENT DOCUMENTS

| | | | |
|---|---|---|---|
| 3,758,775 | 9/1973 | Hopkins | 246/125 |
| 3,784,970 | 1/1974 | Simpkin | 340/902 |
| 3,997,868 | 12/1976 | Ribnick et al. | 340/902 |
| 4,108,405 | 8/1978 | Gibson | 246/473.1 |
| 4,704,610 | 11/1987 | Smith et al. | 340/906 |
| 4,775,865 | 10/1988 | Smith et al. | 340/906 |
| 4,934,633 | 1/1990 | Ballinger et al. | 246/125 |
| 4,942,395 | 7/1990 | Ferrari et al. | 246/473.1 |
| 5,429,329 | 7/1995 | Wallace et al. | 246/473.1 |

FOREIGN PATENT DOCUMENTS

| | | | |
|---|---|---|---|
| 60881 | 3/1990 | Japan | 246/473.1 |
| 4055163 | 2/1992 | Japan | 246/121 |

*Primary Examiner*—Robert J. Oberleitner
*Assistant Examiner*—S. Joseph Morano
*Attorney, Agent, or Firm*—George Wolken, Jr.

[57] ABSTRACT

The present invention provides a signalling system for a railroad locomotive, providing the locomotive with the capability to signal its approach to upcoming railroad crossing signals in order for the crossing signals to activate lights, bells or similar warning devices. The present invention includes a global positioning system receiver mounted within the locomotive for the purpose of determining the train location and, therefore, its proximity to the known locations of railroad crossings. The present invention also includes a self-diagnostic mechanism within the crossing signal device capable of performing certain internal checks for proper functioning of the warning devices. Such information, along with a digitally encoded identification of the particular crossing, is relayed to the locomotive as it passes the crossing. Thus, maintenance information concerning every railroad crossing so equipped is automatically collected on the locomotive-based system for frequent interrogation at service locations, and subsequent crossing-specific maintenance. Also included in the present invention is the capability to signal the approach of a locomotive directly to specially equipped motor vehicles. Further embodiments of the present invention include the capability for a locomotive to signal its position to other locomotives for purposes of collision avoidance.

11 Claims, 5 Drawing Sheets

RAILWAY TRAIN SIGNALLING SYSTEM FOR REMOTELY OPERATING WARNING DEVICES AT CROSSINGS AND FOR RECEIVING WARNING DEVICE OPERATIONAL INFORMATION

FIELD OF INVENTION

This invention relates generally to a signaling system for railroad trains. More particularly this invention relates to a self-contained system for installation on railroad locomotives and at railroad crossing locations for signalling the approach of a train to the crossing, or the presence of a disabled train, including; a system for determining the train's location, speed and direction, control, signalling and data collection means on the locomotive; receiver-transmitter and warning means at the railroad crossing; and optional self-contained power supply and warning devices on motor vehicles.

BACKGROUND OF INVENTION

In many parts of rural America, it is common for roads carrying motor vehicular traffic to cross railroad tracks without gates, warning lights, or signalling means being provided to warn the motorist of oncoming trains. In such circumstances at these unguarded crossings, it is incumbent upon the motorist to approach the crossing carefully, to look and to listen for approaching trains, and to proceed only with assured clearance before any approaching trains. This "self-help" philosophy works satisfactorily when careful, alert motorists approach the unguarded crossing. However, this system contains many traps for the unwary, careless, distracted or impaired motorist, or motorists approaching the railroad crossing under conditions of reduced visibility such as fog, falling snow, etc.

Frequent users of such an unguarded railroad crossing easily become careless about attentively looking for approaching trains. Seldom-used rail lines easily lull the motorist into false security about the improbability of an approaching train. The motorist may easily forget, become careless, rushed or otherwise approach the rail crossing without employing prudent safety measures. When, as typically happens, the careless motorist nevertheless navigates the railroad crossing without incident, the sense of security increases. Such inattentiveness prepares the motorist for disaster when a train approaches.

The infrequent user of a particular unguarded railroad crossing is likewise subject to certain dangers. Lacking descending gates, bells, warning lights or other conspicuous means of drawing the motorists attention to the crossing, the inattentive motorist not familiar with the particular road may not notice the approaching rail crossing until it is too late to take prudent safety measures with consideration of the speed of his or her vehicle. During periods of darkness, inclement weather, or any condition of reduced visibility, it becomes that much more difficult for the motorist to observe and then identify the unexpected railroad crossing. The motorist not expecting a rail crossing may be slow to detect and identify the crossing, slow to react in safely slowing the vehicle, and slow to look and listen for approaching trains. Once again, the infrequency of use of the particular railroad by trains almost always rescues the inattentive motorist from the consequences of his or her negligence. However, the results are serious indeed when the unmindful motorist encounters the infrequent approaching train.

Railroad corporations have employed a variety of safety measures to increase the safety of crossings. Descending gates seem to be the preferred means of maximizing motorist safety from the dangers of approaching trains. Along with descending gates, warning bells and flashing lights are also employed to arouse the possibly lackadaisical motorist with the warning of an approaching train. At rail crossings of the highest traffic volume, descending gates, flashing lights and bells all are typically employed for maximum warning to the motorist of an approaching train. However, there are many other rail crossing locations at which only flashing lights and bells are used, without descending gates.

The use of flashing lights, bells and descending gates have several safety effects. The descending gates make it physically much more difficult for the motorist to cross the railroad track. The gate directly in the path of the motorist makes it all but impossible for the motorist to fail to receive the information that a train is approaching and adjustment of driving is required. In addition, the descending gates, lights and bells are customarily activated only when a train is approaching. Therefore, the motorist learns to take no special safety precautions at such rail crossings unless and until the motorist is warned by activation of the gates, lights and/or bells. When such a motorist approaches an unguarded rural crossing, the mental processes of the motorist must be adjusted in several important ways. The motorist must first detect the rail crossing itself, typically by noticing an unlighted sign (typically, but not always, containing only reflectors). The motorist must then realize that this particular crossing carries no train-activated warning system. Therefore, contrary to his learned behavior from guarded crossings, the motorist must proceed only after conducting a cautious investigation for himself for approaching trains, even in the absence of special warning lights, bells or gates. It is not difficult to understand how an inattentive, lackadaisical or negligent motorist may not make these mental adjustments quickly enough to guarantee safety upon the sudden encounter of an unguarded rail crossing.

It would be prohibitively expensive for railroads to provide the customary train-activated gates, bells or warning lights at all such rural, presently unguarded, crossings. The expense typically involves the acquisition and installation of the safety devices as well as the inspection of the devices to insure proper functioning. Maintenance may be especially time-consuming and expensive due to the far-flung and numerous rural crossings added to the inspector's duties. However, maintenance must not be diminished since a malfunctioning train-activated warning device is especially dangerous for the motorist. Such motorist may have come to rely on the absence of warning as a clear indication of the absence of an approaching train. The absence of warning in spite of the presence of an approaching train (due to a malfunctioning warning device) could seriously increase the liability of the railroad for subsequent train-vehicle collisions.

In addition to the expense of acquisition, installation, and maintenance of many rural railroad crossing warning systems, the expense is further increased by the absence of convenient electrical power at many such locations. Battery operated warning systems exacerbate the problems of upkeep and maintenance by requiring frequent inspections and replacements or recharges of the battery.

However, formerly rural, rarely used, crossings may quickly become subject to heavy flows of motor vehicle traffic as living patterns, and the expansion of metropolitan areas, quickly spread population into rural regions. It has frequently been the case that railroads have been unable to keep up with the expansion of urban areas in their installation and maintenance of crossing safety devices appropriate for greatly increased traffic volume.

For these reasons, there is an apparent need for a self-contained, self-powered, train-activated railroad crossing warning device. The present invention provides such a device with battery power, rechargeable from available incident solar radiation, and activated by a digitally-encoded radio signal from the approaching train. The device of the present invention may also be used in conjunction with power delivered to the crossing location by conventional electrical lines, and need not rely exclusively on battery power. However, even with convenient access to electrical power, the device of the present invention offers several advantages in performance and convenience, as described in detail below. Although the capability of self-contained operation remote from sources of electrical power is one important advantage of the present invention, it is not the only such advantage.

The present invention also provides self-diagnosis for various conditions of malfunction, such as low battery, malfunctioning or burned out warning lights, bells, etc. The maintenance expense is considerably reduced by the practice of the present invention by the provision of communication from the crossing warning device back to the approaching locomotive. The locomotive thus collects from each crossing it encounters, suitably encoded information concerning location and the condition of the warning device and the need for maintenance. This information may be collected frequently by railroad maintenance personnel from the locomotive to provide for specific maintenance at much reduced costs, by permitting maintenance workers to skip visits to crossing signals reporting that all is well. Use of the locomotive as the receiver for such self-diagnostic information from the crossing warning device permits a low power, short range transmitter to be used by the crossing device itself. Thus, interference from numerous devices transmitting to a central maintenance facility is avoided, and power consumption is kept small.

The present invention makes use of the "Global Positioning System" (hereinafter, "GPS") to allow the locomotive to determine its location to an accuracy of typically several yards. GPS is a satellite signalling system allowing any properly equipped GPS receiver on earth to determine its location rapidly and reliably. The present invention uses GPS to locate the train for purposes of controlling nearby crossing signals, and only those designated crossing signals. The length of the train would typically be entered into the locomotive's on-board computer system at the start of each run. This allows the GPS data concerning the location of the locomotive to be easily translated into information concerning the location of both the front and rear of the train (accurate typically to within several yards). The GPS data is also used in the present invention to signal a warning to all trains in the vicinity should the particular train become disabled and obstruct the tracks. Transmission of such emergency "May Day" signals alerts all nearby trains to take appropriate collision-avoidance procedures, and provides all approaching trains with the locations of the front and rear of the disabled train.

GPS positional information from the locomotive is easily used to calculate, in an approximate manner, the locomotive's speed and direction. Consecutive locations of the locomotive may be subtracted to approximate the distance and direction of the locomotive's travel. Dividing the distance travelled by the time required to traverse such distance gives an approximation of the locomotive's speed. However, such information will not be highly precise due to two primary sources of error: 1) the inherent errors in the GPS location of the locomotive will increase in relative effect as differences between two such locations (typically, not too far apart) are employed to compute distance and speed; and, 2) curvature of the locomotive's path between two consecutive GPS readings will not typically be known, leading to errors in the computation of the locomotive's speed, distance travelled, and direction of travel. (It is possible that data for each rail line could be stored in the appropriate computer, including track curvature at each GPS location along each rail route. This route information could then be used to estimate, and reduce, the curvature errors noted above. However, it is presently believed that the increased complexity of such collection, storage and utilization of detailed route data will typically not be worth the extra efforts required. This may not always be the case, and the present invention permits such direct generalization.)

Devices have been developed to provide for warning motor vehicles of the approach of emergency vehicles, and to adjust intersection lights accordingly (U.S. Pat. Nos. 3,784,970; 3,997,868; 4,704,610; 4,775,865). However, these devices do not address the particular problems associated with remote, rural railroad crossings; typically, the need for self-diagnostic information related to the condition of the device, or the inclusion of digital encoding for selective activation and interrogation of each warning device. In addition, such devices typically send indiscriminate signals to all intersections and vehicles within range based merely on the strength of signal. Unlike the present invention, such devices do not provide for the signalling vehicle to determine its location and send coded signals for activating specific devices. Such features, and several other novel features as described in detail below, are provided by the device of the present invention.

SUMMARY OF THE INVENTION

The present invention provides a signalling system for a railroad locomotive, allowing such locomotive to signal its approach to upcoming railroad crossing signals in order for the crossing signals to activate lights, bells or similar warning devices. One embodiment of the present invention includes a global positioning system ("GPS") receiver mounted within the locomotive for the purpose of determining the train location (as well as speed and direction of travel) and, therefore, its proximity to the known locations of railroad crossings. When approaching to within a predetermined distance of such a railroad crossing, the locomotive will signal the crossing to activate the crossing warning devices. The present invention also includes self-diagnostic means within the crossing signal device capable of performing certain internal checks such as low battery, burned out bulb, and similar internal checks for proper function. Such information, along with a digitally encoded identification of the particular crossing, is relayed to the locomotive in passing. Thus, maintenance information concerning every railroad crossing so equipped is automatically collected on the locomotive-based system for frequent interrogation at service locations, and subsequent crossing-specific maintenance. Also included in the present invention is the capability to signal the approach of a locomotive directly to specially equipped motor vehicles, typically school buses, trucks or the like, which may be approaching the railroad crossing. Further embodiments of the present invention include the capability for a locomotive to signal its position to other locomotives for purposes of collision avoidance should the sending locomotive become disabled and obstruct passage along the tracks.

OBJECTS OF THE INVENTION

A primary object of the present invention is to provide signalling means from a railroad locomotive to a railroad crossing to turn on warning devices at such crossing.

Another object of the present invention is to provide signalling means from a railroad locomotive to motor vehicles to warn such vehicles of the approach of the locomotive.

Yet another object of the present invention is to provide for automatic determination of the location of the locomotive by means of a global positioning receiver within the locomotive.

Another object of the present invention is for a railroad locomotive to provide signals coded for reception by a designated rail crossing only.

Another object of the present invention is to provide a signalling system at a railroad crossing providing diagnostic information concerning its operating condition or need for maintenance to a nearby locomotive.

Yet another object of the present invention is to provide for emergency transmission of the location of a disabled locomotive to nearby receivers to aid in collision avoidance or another emergency response.

Yet another object of the present invention is to provide for automatic determination of the speed of the locomotive by means of a global positioning receiver within the locomotive.

Yet another object of the present invention is to provide for automatic determination of the direction of travel of the locomotive by means of a global positioning receiver within the locomotive.

DESCRIPTION OF PREFERRED EMBODIMENTS

Figure 1:
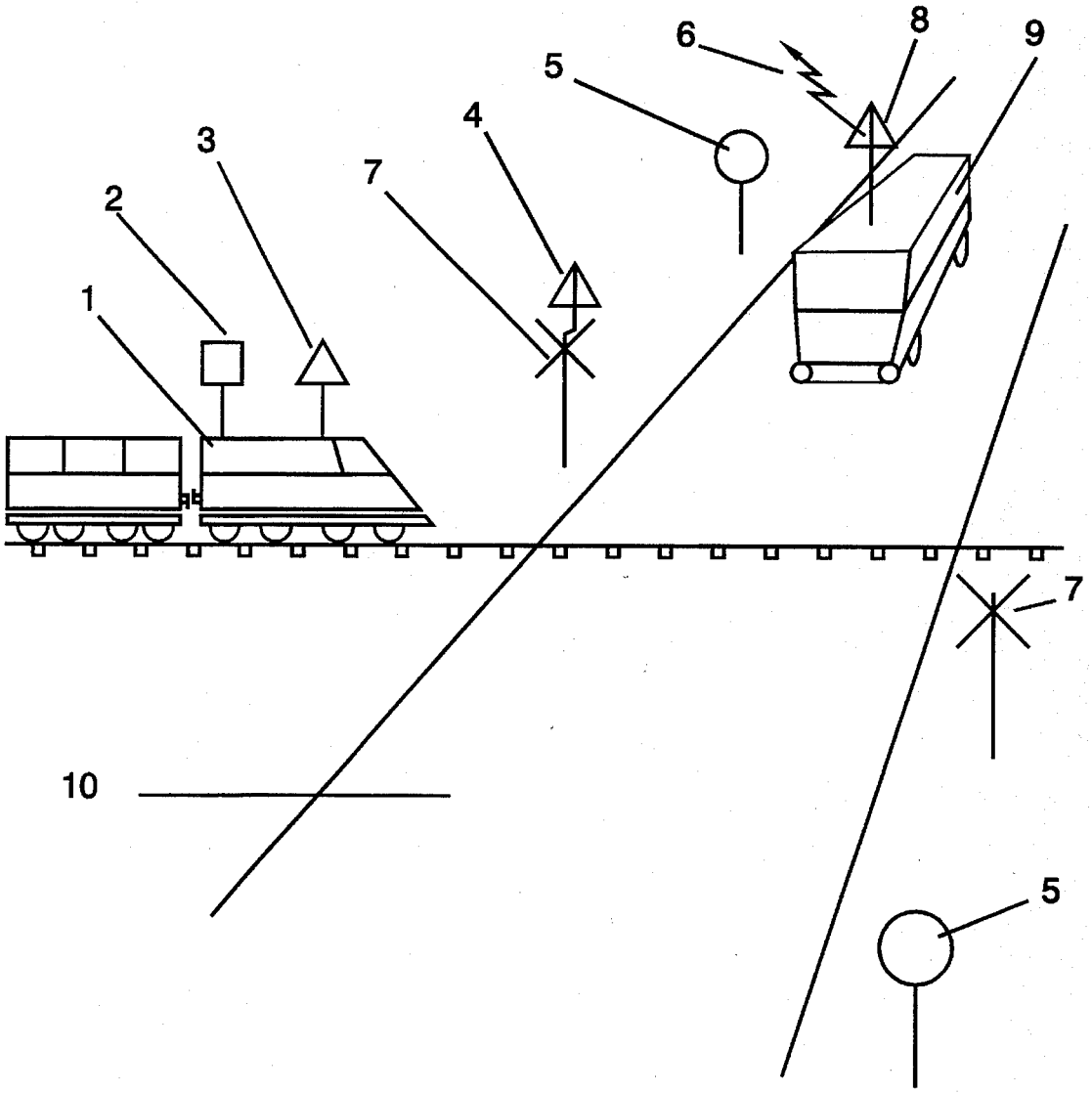
FIG. 1. Schematic diagram of a railroad locomotive and train approaching a railroad crossing, including an approaching motor vehicle and typical railroad crossing warning devices.

FIG. 1 shows in schematic form the overall functioning of an embodiment of the present invention. We first describe the general functioning of the present invention, in terms of the overall system before undertaking a detailed description of the components of the embodiments presently preferred for the practice of this invention.

A locomotive, 1, is typically envisioned as being equipped with two antennas. One such antenna, 2, is to receive information from a global positioning system ("GPS"). Such information will be processed by the locomotive's on-board systems in order to determine the position of the locomotive. It is envisioned that the accuracy obtainable with the present GPS system will be of the order of several tens of feet. In any event, the accuracy of the GPS is expected to be well within the requirements of the present locomotive signalling system for safely activating crossing signals or sending information of motor vehicles or other locomotives.

As discussed above, GPS positional information received by the locomotive can be used to calculate the locomotive's approximate speed and direction. Vector subtraction of GPS information giving consecutive locations of the locomotive yield the approximate distance and direction of the locomotive's travel. Dividing this distance travelled by the time required to traverse such distance gives an approximation of the locomotive's speed. However, such information will be subject to at least two sources of error: 1) the inherent errors in the GPS location of the locomotive will increase in relative effect as differences between two nearby locations are employed to compute distance and speed. That is, small differences between large numbers are notoriously inaccurate. 2) Curvature of the locomotive's path between two consecutive GPS readings will not typically be used in computing its speed and distance, using straight-line estimates for ease and speed of computation. This leads to errors in the computation of the locomotive's speed, distance travelled, and direction of travel. It is possible that the data for each rail line stored in the appropriate locomotive on-board computer would include track curvature at each GPS location along each rail route. This route information could then be used to estimate, and reduce, the curvature errors in computing speed, distance and direction. However, it is presently believed that the increased complexity of such collection, storage and utilization of detailed route data will typically not be worth the extra efforts required. This may not always be the case, and the present invention permits such direct generalization with moderate increases in software and computational complexity.

The locomotive, 1, is also typically equipped with a second antenna, 3. Antenna, 3, is expected both to send and to receive signals. A primary function of antenna, 3, is for communication with the signal and warning system located at the railroad crossing by means of antenna, 4, mounted on the crossing warning device, 7. The typical railroad crossing has a road, 10, carrying motor vehicles, 9, to and from over the railroad tracks. Commonly, the railroad crossing is equipped with signal lights, 5 often being installed by the state authorities. Typically, such railroad crossing will also be equipped with warning devices, 7, installed by the railroad. In general, these warning devices will consist of some or all of the following: coloration to attract attention, reflectors, warning lights, and warning bells. In the practice of the present invention, it is envisioned that the warning system mounted at the railroad crossing on devices 7 will consist primarily of warning lights. In rural locations without easy access to electric power, it is envisioned that the present invention will be powered by batteries located on (on inside) warning devices, 7, typically equipped with solar or other recharging means. Warning devices other than lights will typically draw excessive power and are expected to lead to unacceptably short battery life. However, for locations in which the supply of electrical power is not a serious concern (brought about by improved storage devices for electrical power, use of low power-consuming warning devices, or ready access to commercial supplies of power), the present invention is easily generalized to include warning devices other than lights.

Descending gates are not shown in FIG. 1 since, for remote locations typically envisioned to be the primary use for the present invention, power consumption requirements of such devices are commonly beyond battery operation. However, the advantages of the present system may prove sufficiently compelling to cause its use in other than remote locations. In this case, descending gates can easily be employed at the railroad crossing along with some or all of the warning devices noted above.

It is also envisioned in the practice of the present invention that the crossing warning devices, 7, will perform self-diagnostic checks on their internal condition. Such internal checks (described in more detailed below) could typically include battery condition, non-functioning lights or other devices, as well as additional internal checks. This information could typically be transmitted via antenna, 4, back to locomotive, 1 for reception on antenna, 3. This information would typically be retrieved from the memory on board locomotive, 1, upon its stop at a suitable maintenance facility. This will give railroad maintenance personnel accurate information concerning which crossings are in need of attention. When passing each crossing, the locomotive will receive from the crossing warning devices, 7, one of three types of information include: 1) A signal denoting that the warning devices are functioning properly and battery life is adequate; or 2) A signal denoting certain problems with the warning devices; or 3) No intelligible signal. In the event of occurrence (2) or (3), the railroad personnel know to give immediate attention to the particular warning device.

We show in FIG. 1 communication with railroad crossing devices by means of a single receiver-transmitter antenna, 4. It is envisioned that this will be the preferred mode of operation with all other warning devices located at the crossing connected to this single receiver-transmitter antenna by means of hard wiring (or possibly local communication systems). However, nothing in this invention excludes the use of more than one receiver-transmitter at each railroad crossing for increased safety, redundancy, etc.

Locomotive, 1, will also typically posses the capability to communicate to nearby motor vehicles, 9 by means of a vehicle-mounted onboard receiver and antenna system, 8, for the reception of signals, 6, transmitted from the locomotive antenna, 3. Such devices will represent an added cost to the owner of each motor vehicle. As such, it may not be universally employed. Nevertheless, the safety advantages of the present invention exist whether or not :motor vehicles approaching the railroad crossing are equipped with such a device. However, for vehicles such as school buses, other buses, trucks, or emergency vehicles the expense may be justified in terms of the additional personal safety. In any event, transmission from locomotive, 1, to motor vehicles, 9, is an optional, but not necessarily essential, feature of the present invention.

Figure 2:
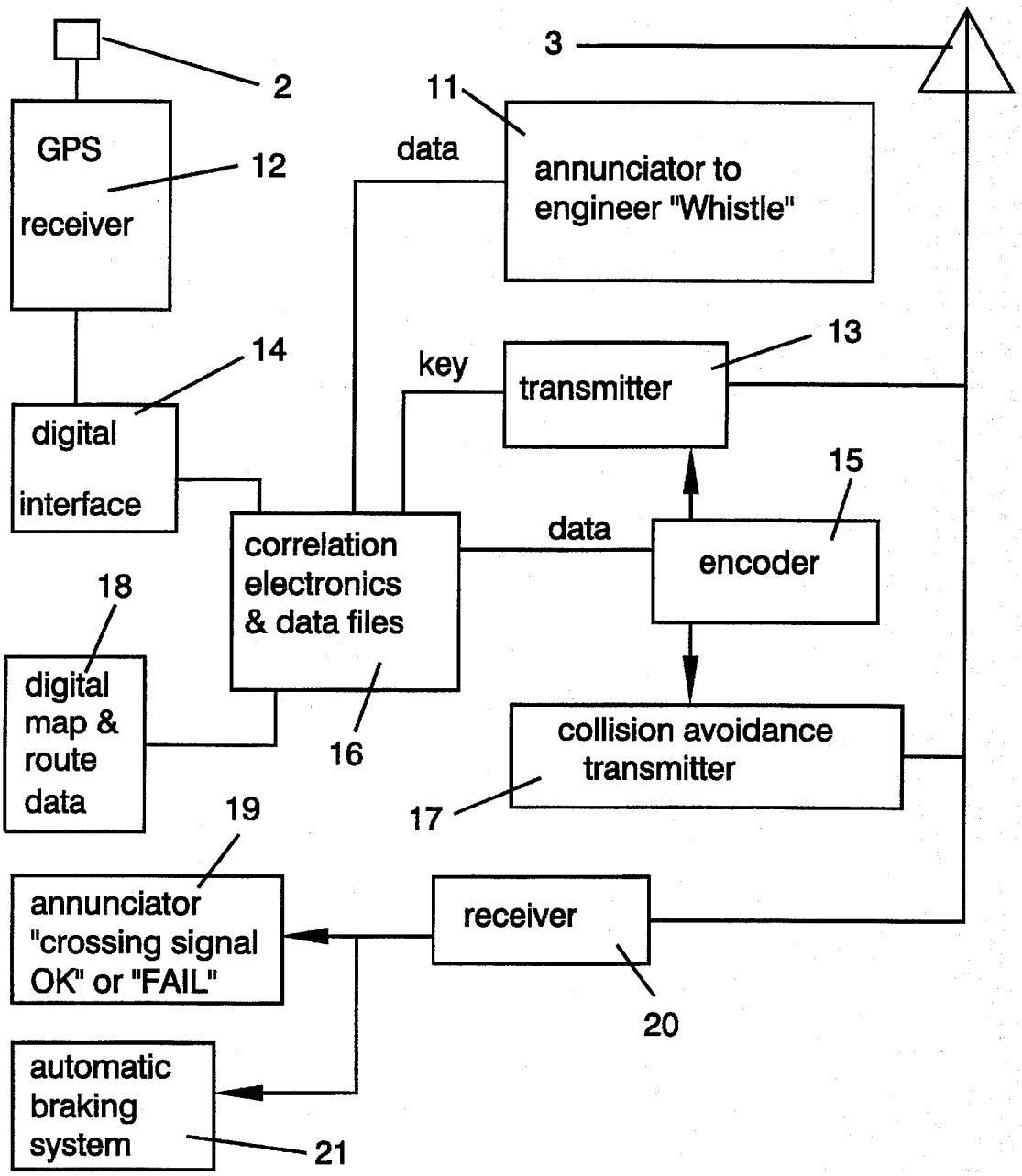
FIG. 2. Block diagram of the system on board the locomotive, including means for determining the location of the locomotive, means for receiving information from the railroad crossing signalling system, means for transmitting to the railroad crossing, motor vehicles, and other locomotives, and other control, dam storage and communication means.

FIG. 2 shows details concerning the structure of the system located on board the locomotive, in block diagram form. FIG. 2 does not include the power supply for providing electrical power to the device, or other necessary and obvious features in the construction of the device. The block diagrams provided herein incorporate the essential features of the present invention which describe its structure and function.

For one embodiment of the present invention, location of the locomotive is determined by means of GPS data received via antenna 2 into GPS receiver 12. Such receivers are well known in the art to surveyors and others concerned with use of GPS to determine location. No special processing of the GPS information is envisioned for the practice of the present invention. Typically, in the practice of the present invention GPS data will be continuously monitored by receiver 12 and, thus, continuously monitor the location of the locomotive (as well as speed, distance and direction of travel when required).

The GPS data is processed via a digital interface, 14 and delivered to correlation electronics, 16. 16 will typically be a microprocessor or similar microelectronics for the processing and control of the locomotive system. Shown as 18 in FIG. 2 is the data file holding that information typically required for the operation of the present system on the locomotive Information stored in 18 will typically encompass the route data for the particular railroad system. Comparison of the route data with the location of the locomotive, as continuously generated by the GPS receiver, will generate by means of electronics 16, a warning of an approaching crossing.

When the GPS data, in conjunction with the route data stored in 18, demonstrates that the locomotive is approaching a railroad crossing, several actions are taken. The data is sent to an annunciator, 11, which will notify the locomotive engineer (by means, typically, of a warning light, buzzer or both) that a crossing is approaching and the train whistle must be sounded, or other actions taken in accordance with regulations. In addition, transmitter 13 is activated which sends information to the upcoming crossing to turn on the warning devices. The codes for each particular crossing will typically be stored in 18 and transmitted as a digitally coded prefix through 15, preceding the instructions to turn on warning devices Thus, only the crossing for which the proper coded prefix is transmitted will be activated, This will permit the railroad to designate the specific crossing to be activated, and only that crossing. Of course, multiple crossings can be activated by an obvious extension of the present invention merely by causing the transmitter to transmit activation signals with several coded prefixes for each of several crossings. For particular routes, it is envisioned in the present invention that crossing location data will be stored sequentially in 18 for ease of location, although random search through properly constructed crossing-location files may also be employed.

Another feature of the present invention is the ability to cause transmitter, 13 to instruct the correct crossing to turn off the warning devices. It is envisioned that, at the start of each run, the locomotive personnel will enter into the data storage location, 18, the length of that particular train. Thus, the GPS data locating the locomotive, and the length of the train stored in 18, easily allows both the start and the end of the train to be located to an accuracy of the typical GPS data. Thus, when the GPS data indicates that the locomotive has passed the crossing by sufficient distance for the end of the train to have cleared also, transmitter 13 will instruct the warning signals to turn off. This system can be backed up by load cells installed at the site of the crossing, sensitive to the train but not capable of detecting other motor vehicles. Thus, a "turn off" signal generated by the locomotive, taking account of the position of the locomotive and the length of the train, will turn off the warning devices if and only if no train is detected in the intersection by the load cell.

Also included on the locomotive is a collision avoidance transmitter, 17. Should the train become disabled and obstruct the track, other trains using that track need to be notified. This is done by using a special emergency code which is detected by all locomotive-based receivers. The presence of an emergency coded prefix alerts nearby locomotives that a problem is occurring. The emergency coded prefix is followed with information giving the location of the train in distress, both as to start and end of the train. This combination of emergency code and location information should provide sufficient opportunity for nearby trains to undertake appropriate collision avoidance procedures if they are on the track headed toward the train in distress. If the disabled locomotive lies in the path of the receiving locomotive, automatic breaking procedures via 21 can be instituted.

The transmitter for communicating with the railroad crossing, 13, will typically have a range of about 2 miles. However, for emergency collision avoidance, it is prudent to have a range of about 10 miles. Thus, a separate and more powerful transmitter, 17, will typically be used for collision avoidance transmissions, along with the special emergency coded prefix.

In addition to emergency collision avoidance procedures, each locomotive will typically receive information from the crossing itself. The crossing will transmit to the locomotive a digitally coded prefix which serves to identify the crossing. The information is received and stored in the data storage area of the locomotive on-board system. This information serves to alert the railroad maintenance personnel about the condition of that particular crossing and allows specific, tailored maintenance to be instituted. It is envisioned that such procedures will markedly reduce maintenance costs by allowing maintenance to be omitted for those crossings reporting that all is functioning as it should. If the locomotive receives a correctly coded signal followed by indications of sub-optimal performance for that crossing, maintenance can be provided. Certainly, if a crossing fails to respond with the proper identification code or codes, this is clear indication of trouble and immediate maintenance will be undertaken in this instance also.

Figure 3:
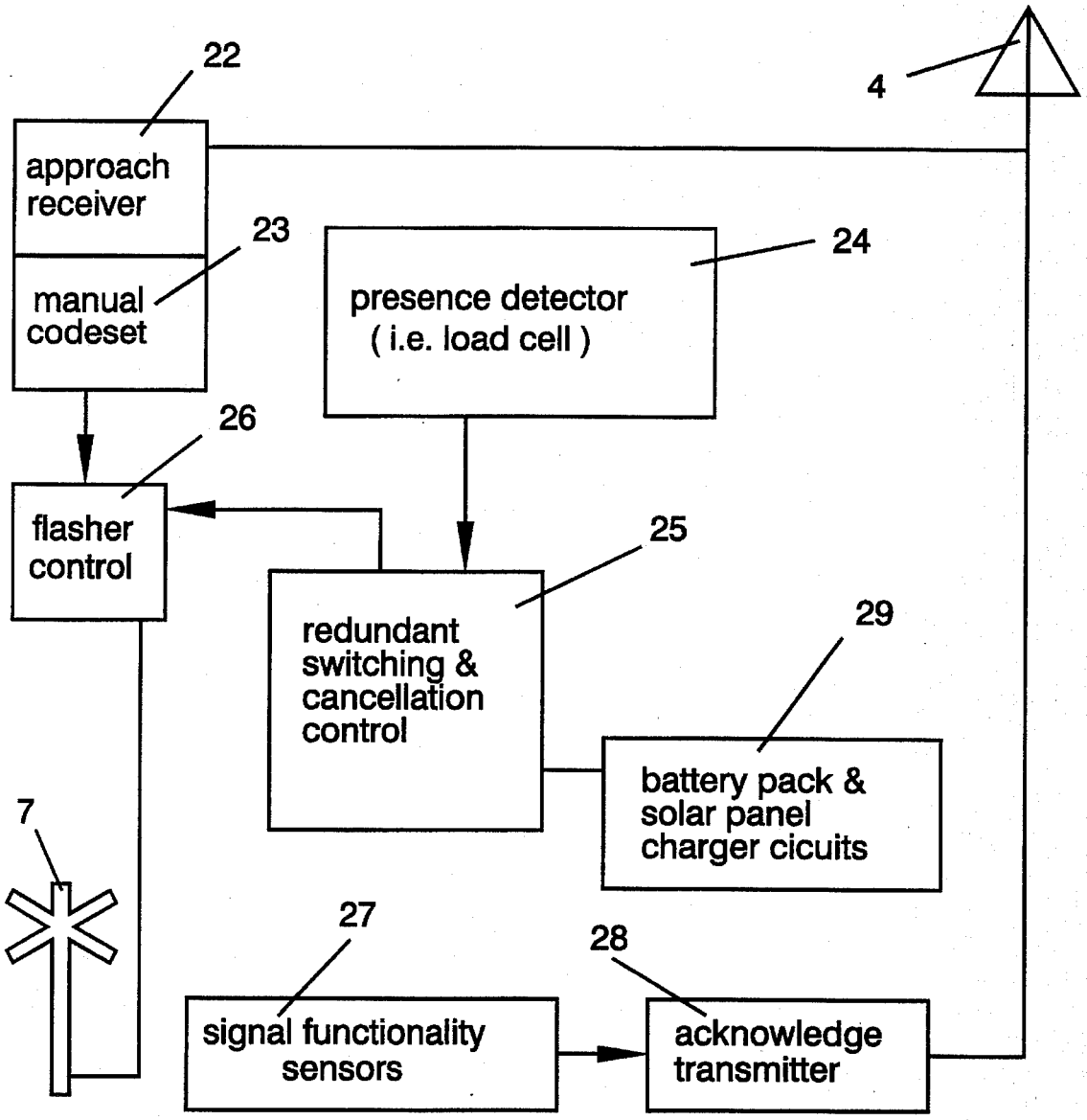
FIG. 3. Block diagram of the system at the railroad crossing including, power supply, means for receiving information from the locomotive signalling system, means for collecting and transmitting to the locomotive certain self-diagnostic information.

FIG. 3 shows, in block diagram form, the transmitting and receiving system mounted as part of the railroad crossing. As insulation from weather and vandalism, it is envisioned that the electronics will be packaged compactly and mounted inside the steel post of signal, 7. However, other mounting schemes can be employed without essentially changing the present invention. We show in FIG. 3 all components separated for ease of description.

The system will typically contain certain self-diagnostic features, shown as 27 in FIG. 3. These may include, but not be limited to, battery charge level, warning light, bell and other warning functions, status of transmitter, and other communication functions. Such information will be combined with the proper digitally coded prefix identifying the particular crossing and sent, via transmitter 28, to the locomotive for storage and later retrieval.

When a locomotive approaches a railroad crossing, it will typically transmit a digitally coded prefix to identify the particular crossing the locomotive wishes to activate. This code will be received by 22 and compared with the appropriate code in 23. Circuit 23 will allow railroad maintenance personnel to change or reset the code which serves to identify the particular crossing. When a properly coded "turn on" signal has been received, the flashers will be activated via 26. As noted above, it is expected that only flashers will be used in most remote location to extend battery life before recharging is required. However, nothing herein precludes activation of bells, descending gates, or other warning (or traffic-restricting) devices as may be prudently employed for a particular crossing.

A load cell is shown as 24 in FIG. 3. This load cell (including in this term a switch or similar device) may serve as back up to the "turn off" signal transmitted by the locomotive, as described above, thorough control 25. The entire crossing warning system is powered by an appropriate battery pack, 29, with a storage device. It is envisioned in the present invention that solar cells would typically be employed to recharge the batteries whenever solar conditions permit. However, this is not to exclude wind or other sources of electrical power as alternative or substitute means for battery recharging.

Figure 4:
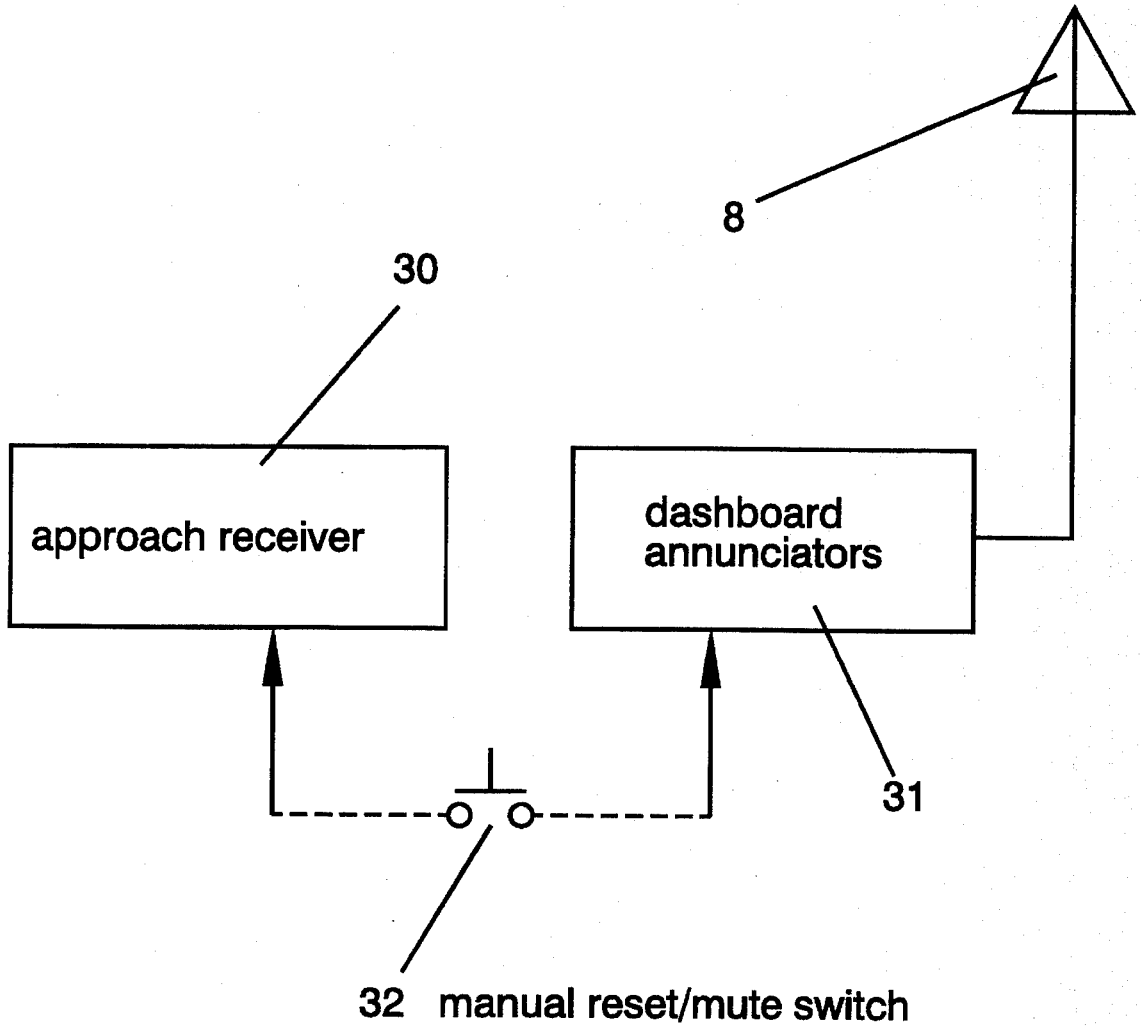
FIG. 4 Block diagram of the system mounted on motor vehicles for detecting the approach of a locomotive by means of signals transmitted by the locomotive.

FIG. 4 shows a receiver system which may be mounted into motor vehicles for separate, individual, warnings for that particular vehicle approaching the railroad crossing. While such devices may not be economical for all private passenger vehicles, it may be justified on the basis of safety for school buses, trucks, emergency vehicles, touring buses and the like. (Although more and more new vehicles include communication options, digital maps, etc. making it increasing more likely that railroad crossing warnings would become an economical addition, even in private passenger vehicles). Such a system would have a receiver, 8, which would receive digitally coded signals from the locomotive. The locomotive would transmit as a normal part of its transmission protocol in approaching a railroad crossing, signals generally coded for all motor vehicles. While the locomotive transmission would typically be separately coded for each particular crossing, it is envisioned that there will be a single, universally applied, code for all motor vehicles. This code would be detected by receiver 30 and serve to actuate dashboard visual or aural alert devices. The system would also typically be provided with a button to mute the alert, and/or to reset the system following passage of the train.

Figure 5:
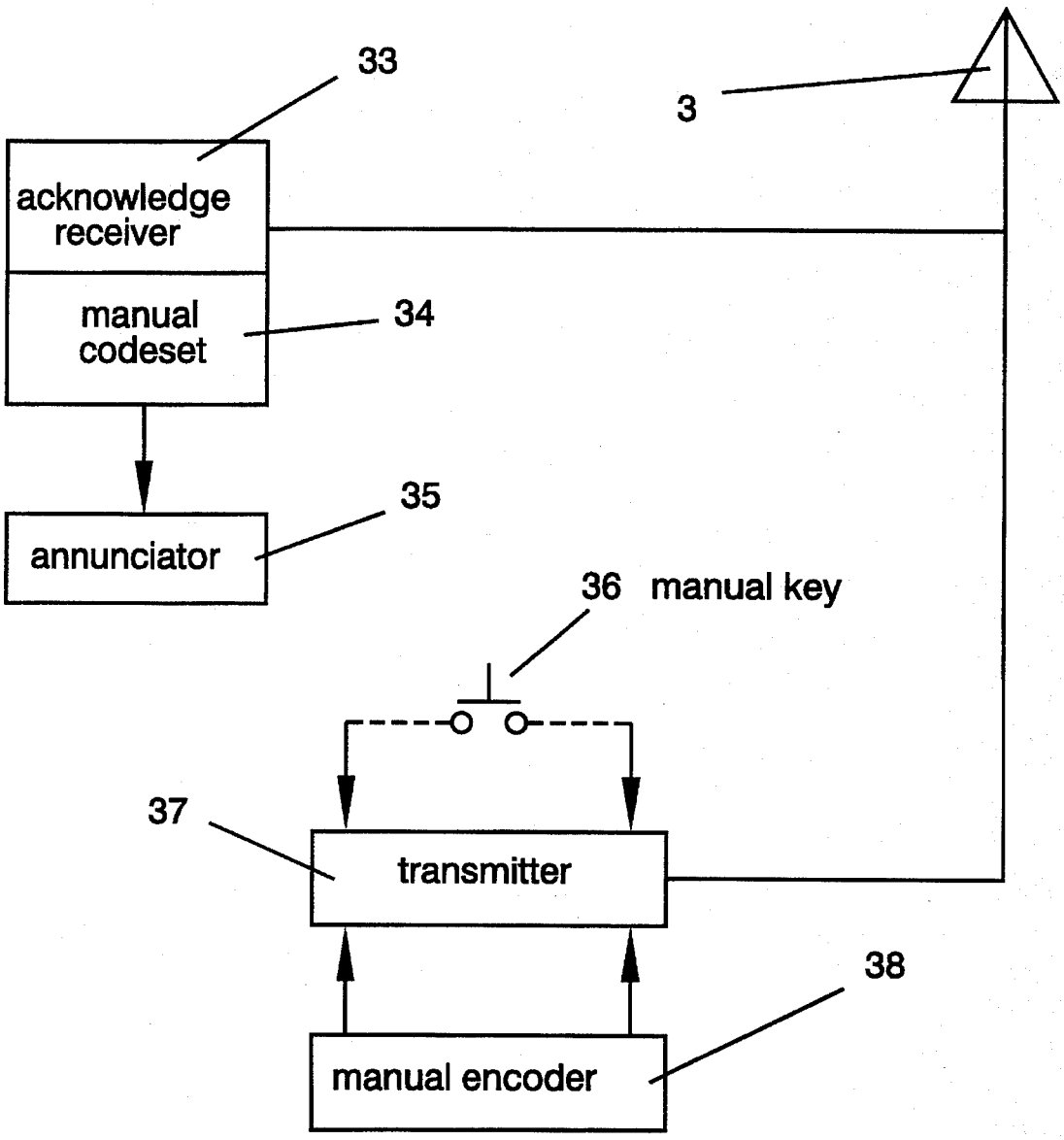
FIG. 5 Block diagram of a simplified embodiment of the signalling on board the locomotive without automatic location determination.

An alternative embodiment of the present invention (as installed on board the locomotive) is shown in FIG. 5 for the instance when GPS location data is not available. In this case, transmission from the locomotive to the railroad crossing warning system is initiated by manual key, 36, through transmitter 37. Encoder 38 will require manual encoding for proper transmission of the digitally encoded prefix for the particular crossing next upcoming. Reception of information via 33, and 34 would store the data from the crossing in a manner analogous to that described above. Annunciator, 35, would typically be employed to affirm for the locomotive engineer that reception from the crossing has been accomplished.

I claim:

1. A signalling system for a railroad comprising:

a) a first transmitter located on a railroad train comprising a transmitter for transmitting first electromagnetic signals from said train sequentially to a plurality of warning devices located at railroad crossings along the route of said train, wherein said first signals comprise first digitally encoded identification means for specifying each of said railroad crossings and further comprise digitally encoded control means for controlling the function of said warning devices located at each of said crossings; and, b) a second transmitter located at each of said railroad crossings comprising a transmitter for transmitting second electromagnetic signals from each of said crossings to said railroad train, wherein said second signals comprise digitally encoded identification means for identification of each of said crossings, and further comprise digitally encoded information relating the operational condition of said warning devices located at said crossings; and, c) a first receiver located on said railroad train comprising a receiver for receiving said second signals and a memory for storing said second signals; and, d) a second receiver located at each of said railroad crossings, comprising a means for comparing said first digitally encoded identification means with a predetermined digital identity code stored internally in said second receiver, and a means for controlling said warning devices at each of said railroad crossings in response to said digitally encoded control means received from said first transmitter whenever said transmitted identity code matches said internally stored identity code.

2. A system as in claim 1 further comprising a means for locating the geographical position of said first transmitter.

3. A system as in claim 2 wherein said means for locating the position of said first transmitter is a global satellite positioning system comprising, on said railroad train in known proximity to said first transmitter, a global positioning receiver and processing means for determining the geographical location of said global positioning receiver from the information received therethrough.

4. A system as in claim 3 further comprising means for said first transmitter to transmit to said second receiver instructions to turn on warning devices whenever said geographical location of said first transmitter is closer than a predetermined distance from the location of said second receiver.

5. A system as in claim 4 further comprising data stored in said first transmitter containing the length of the railroad train.

6. A system as in claim 5 further comprising means for said first transmitter to transmit to said second receiver instructions to turn off warning devices whenever said geographical location of the end of the train carrying said first transmitter is further than a predetermined distance from the location of said second receiver, having passed said second receiver.

7. A system as in claim 3 further comprising means to transmit the geographical location of said first transmitter to receivers located on other railroad trains indicating the geographical position of said first transmitter.

8. A system as in claim 1 further comprising a battery power source providing electrical power to said second transmitter and said second receiver.

9. A system as in claim 8 further comprising solar electrical generating means for recharging said batteries.

10. A system as in claim 1 wherein;

a') said first electromagnetic signals further comprise third digitally encoded identification means for specifying motor vehicles, wherein said third digitally encoded identification means are distinct from said second digitally encoded identification means for identifying said railroad crossings; and, b') said first electromagnetic signals further comprise digitally encoded motor vehicle control means for controlling the function of warning devices located in said motor vehicles; and, c') a third receiver located in said motor vehicles comprising means for receiving said third digitally encoded identification means transmitted by said first transmitter, and further comprises a means for comparing said third digitally encoded identification means with a predetermined digital identity code stored internally in said third receiver, and a means for controlling said warning devices in said motor vehicles in response to said digitally encoded control means received from said first transmitter whenever said transmitted identity code matches said internally stored identity code.

11. A system as in claim 1 further comprising means for retrieving said stored second signals and determining therefrom the identity and operational condition of said railroad crossing warning devices.

* * * * *